US007793359B2

(12) United States Patent
Spiewak et al.

(10) Patent No.: US 7,793,359 B2
(45) Date of Patent: Sep. 14, 2010

(54) PERFORMANCE DUTY UNIFORM FOR LAW ENFORCEMENT AND OTHER UNIFORMED PERSONNEL

(75) Inventors: Roy J. Spiewak, Teaneck, NJ (US); Michael I. Spiewak, New Hope, PA (US); Sol N. Jacobs, New York, NY (US)

(73) Assignee: I. Spiewak & Sons, Inc., Teaneck, NJ (US)

( * ) Notice: Subject to any disclaimer, the term of this patent is extended or adjusted under 35 U.S.C. 154(b) by 590 days.

(21) Appl. No.: 11/233,860

(22) Filed: Sep. 23, 2005

(65) Prior Publication Data

US 2007/0067889 A1 Mar. 29, 2007

(51) Int. Cl.
*A41D 13/00* (2006.01)
*A41D 27/20* (2006.01)

(52) U.S. Cl. ..... 2/69; 2/247

(58) Field of Classification Search ..... 2/79, 2/77, 336, 94, 78.4, 101, 117, 217, 220, 223, 2/229, 231, 236, 320, 337, 247, 251, 271, 2/250; 224/575, 182, 255, 257, 260, 903, 224/914

See application file for complete search history.

(56) References Cited

U.S. PATENT DOCUMENTS

| | | | | | |
|---|---|---|---|---|---|
| 955,649 | A | * | 4/1910 | Lewin | 2/247 |
| 1,827,585 | A | * | 10/1931 | Kautz | 2/247 |
| 2,223,621 | A | | 12/1940 | Knappenberger | |
| 2,476,712 | A | * | 7/1949 | Eisenberg | 2/246 |
| 2,641,760 | A | | 6/1953 | Syracuse | |
| 2,977,602 | A | * | 4/1961 | Cooper | 2/247 |
| 3,298,036 | A | | 1/1967 | Chalfin | |
| 3,590,390 | A | | 7/1971 | Howard et al. | |
| 3,638,658 | A | | 2/1972 | Becker et al. | |
| 3,930,090 | A | | 12/1975 | Campbell et al. | |
| 3,940,039 | A | | 2/1976 | Sasaki | |
| 4,464,798 | A | | 8/1984 | Livingstone | |
| 4,498,200 | A | | 2/1985 | Livingstone | |
| 4,561,124 | A | | 12/1985 | Thompson | |
| 4,608,716 | A | * | 9/1986 | Brumfield | 2/2.5 |
| 5,111,981 | A | | 5/1992 | Allen | |
| 5,123,120 | A | | 6/1992 | Ross | |
| 5,515,544 | A | | 5/1996 | Hosking | |

(Continued)

FOREIGN PATENT DOCUMENTS

| | | |
|---|---|---|
| JP | 02-21003 | 8/1990 |

(Continued)

*Primary Examiner*—Gary L Welch
*Assistant Examiner*—Amber R Anderson
(74) *Attorney, Agent, or Firm*—Abelman, Frayne & Schwab

(57) ABSTRACT

For uniformed personnel a shirt and pants Class A dress uniform having one or more Class B work uniform type of structural features which render it more functional, more comfortable and more attractive. More specifically, this new uniform includes a shirttail retainer, a microphone sling and an internal hidden and secure cargo pocket on each leg or combinations of one or more of these features. The shirttail retainer utilizes spaced apart silicone rubber friction strips on the outer surface near the waist which cooperate with a friction strip on the inner surface of the pants waistband. The microphone sling hangs from a button on the shoulder hidden beneath the shoulder epaulet. The internal cargo pocket is on the inner surface of the outer leg wall.

21 Claims, 5 Drawing Sheets

U.S. PATENT DOCUMENTS

| | | | | |
|---|---|---|---|---|
| 5,669,078 | A | 9/1997 | Scremin et al. | |
| 5,752,632 | A * | 5/1998 | Sanderson et al. | 224/182 |
| 5,886,739 | A | 3/1999 | Winningstad | |
| 5,915,609 | A | 6/1999 | Diakoulas | |
| 6,088,831 | A | 7/2000 | Jensen et al. | |
| 6,175,966 | B1 | 1/2001 | Weisenthal | |
| 6,253,379 | B1 | 7/2001 | Collier | |
| 6,704,942 | B2 * | 3/2004 | Lazarian | 2/409 |
| 7,065,792 | B2 * | 6/2006 | Hautala | 2/69 |
| 7,398,558 | B1 * | 7/2008 | Kattenhorn | 2/79 |
| 2003/0019015 | A1 | 1/2003 | Hugh | |
| 2003/0150042 | A1 | 8/2003 | Leflet et al. | |
| 2004/0187183 | A1 | 9/2004 | Hautala | |

FOREIGN PATENT DOCUMENTS

| | | |
|---|---|---|
| JP | 10-130-901 | 5/1998 |

* cited by examiner

FIG. 4
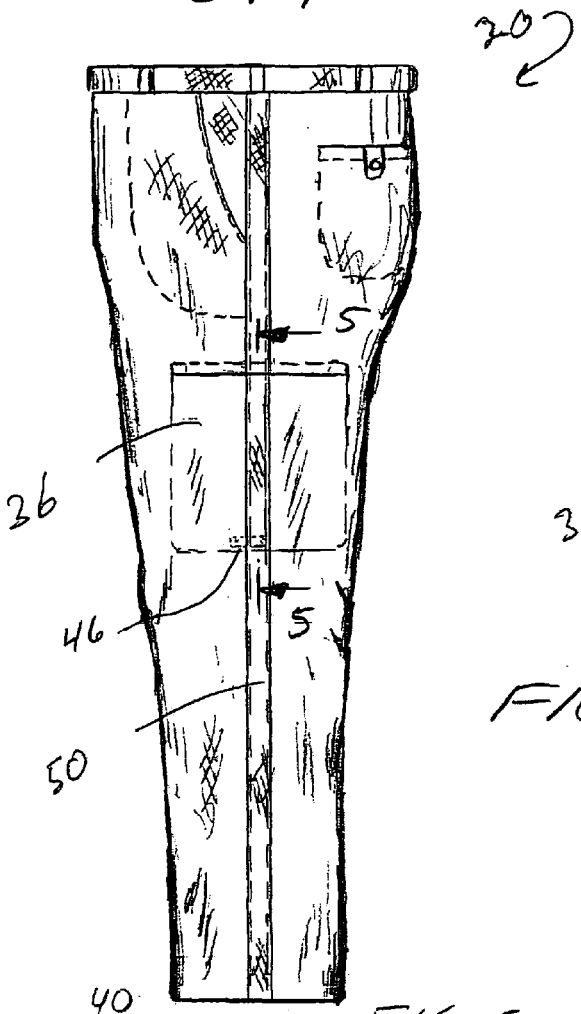
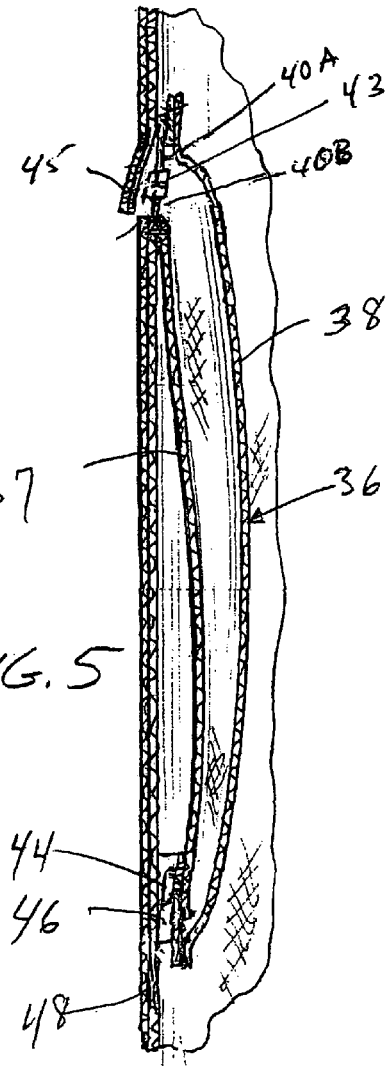
FIG. 5
FIG. 6
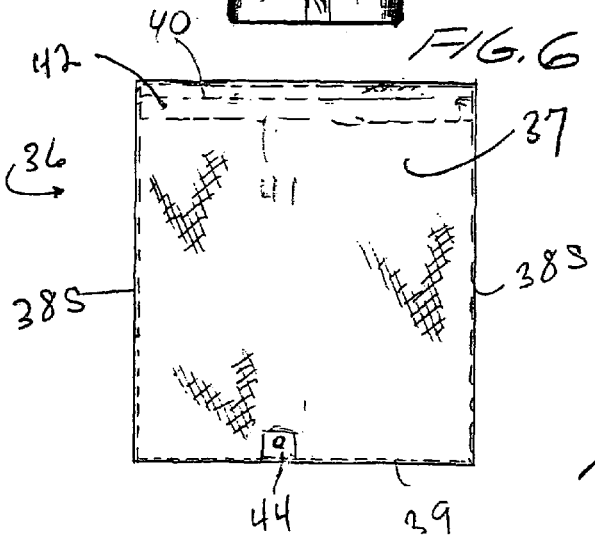
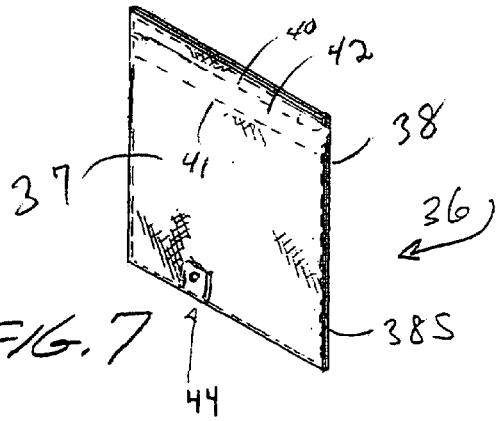
FIG. 7

PERFORMANCE DUTY UNIFORM FOR LAW ENFORCEMENT AND OTHER UNIFORMED PERSONNEL

A. BACKGROUND

1. Field of the Invention

This invention is in the field of uniforms worn by law enforcement, fire and other uniformed personnel, and particularly by persons who need to carry special equipment such as a two-way radio, a weapon, a bullet-proof vest or other body armor inside or on the uniform. This invention pertains to both Class A "Dress" or "Appearance" uniforms and Class B "Utility" or "Work" uniforms.

2. Background of the Invention

In police departments across the country police personnel Class A or "dress" uniforms are the standard for normal workdays, whereas Class B or "work or utility" uniforms are usually limited in use for tactical functions, SWAT team, search, rescue and emergency service units and the like. The Class B "work" uniforms tend to be more comfortable and more functional, in contrast to the Class A "dress" uniforms that obviously need to provide an official and neat appearance. In actual use, however, Class A uniforms must also accommodate numerous items of special equipment which basic Class A shirt-and-pants uniforms were never intended to hold or hide. For example, a bulletproof vest, of necessity, is thick, bulky and somewhat stiff, so that shirttails of a uniform shirt covering such vest will tend to pull out from the pants' waistband. There are many circumstances where a policeman is wearing a Class A uniform without special equipment, but where the policeman is physically active, by running, squatting and/or bending, where normal shirt tails tend to come out. These uniforms will not only appear sloppy, which is inconsistent with typical police or military philosophy, but it may interfere with a policeman's ability to carry out his duties with his weapons, communication or other equipment. For many, shirttails even partially hanging out of a waistband are annoying, uncomfortable, and/or aesthetically displeasing.

Class A uniforms become further distorted by the equipment carried on or in the uniforms, such as a heavy belt around the waist for a gun, a nightstick or billy club, a two-way radio and a ticket pad. Many devices and shirt and/or pants constructions have been developed in efforts to try to retain shirttails neatly within pants' waistbands, examples being disclosed in U.S. Pat. Nos. 6,088,831; 5,123,120; and 3,298,036. Still further but less relevant prior art patents include: U.S. Pat. Nos. 2,223,621; 3,590,390; 3,638,658; 3,930,090; 5,515,544; and Japan 10-130-901.

Obviously, a pants-and-shirt uniform will have numerous pockets, but there are practical limits. In shirts, for example, pockets are essentially limited to the upper front area, with the back, waist and collar being impractical areas for pockets and the sleeves being too small for useful pockets and also impractical for pockets if an outer jacket will be worn. Uniform pants have the usual front and rear pockets which are internal and essentially not visible except for the conventional access slits. Rear patch pockets, as seen on typical dungarees, are not considered acceptable dress for Class A uniforms, and furthermore have very limited capacity, because they lie flat and close to the seat portion of the pants.

A pocket invention that has been used with military "field" uniforms, where appearance obviously defaults to utility, is an external cargo pocket which, due to side gussets or pleats, may have the ability to expand to hold very large capacity.

Such cargo pockets have been positioned along the outside surface of each pant leg side, positioned near the thigh, the knee and/or the calf.

External cargo pockets not only have great utility, but have become immensely popular in casual non-military clothing and in Class B utility uniforms. These cargo pockets may in fact not even have side gussets or pleats, but are still known as cargo pockets due to their large storage capacity and positioning on the side of the pant leg. However, such external cargo pockets are not acceptable for use in Class A uniforms for police departments and for many other governmental or business organizations or military dress uniforms.

Many prior art shirt and/or pants construction have been developed in efforts to provide additional or different pocket spaces, examples being disclosed in U.S. Pat. Nos. 2,977,602; 4,464,798; 4,498,200; 4,561,124; 5,669,078; 6,175,966; 6,253,379; US2003/0150042; and Japan 0221003.

A third problem area with current Class A uniforms is the conventional but awkward attachment of a microphone to a shirt collar or front breast pocket. Placement on collars and pockets is often not optimum for voice communication, and such placement with conventional clips eventually damages the fabric and thus damages the appearance of these most visible portions of the shirt. A number of prior art microphone attachment means have been developed in efforts to provide quick, easy and good functional attachment, examples being disclosed in U.S. Pat. Nos. 2,641,760; 3,940,039; 5,111,981; 5,886,739; 5,915,609; US2003/0019015; and US2004/0187183.

In summary, the present invention addresses three problem areas:

a. shirttails coming out of waistbands because of active running, bending or squatting, or because of body armor and/or other equipment pulling or protruding, b. dress pants having insufficient large capacity pockets for the greater amount of hidden utility equipment required to be carried, and c. awkward and fabric damaging attachment of microphones to shirt collars and/or front pockets.

B. OBJECTS AND SUMMARY OF THE NEW INVENTION

This invention is an improved uniform that provides both Class A appearance and Class B functionality in a new dress uniform for law enforcement and other uniformed personnel who need to carry, on or inside the uniform, special equipment such as a two-way radio, a weapon, a bullet-proof vest or other body armor and miscellaneous other items. This uniform invention comprises pants and shirts alone or in combination, having new structural features that address any one or any combination of the three problem areas described above. More specifically, a first feature to restrain shirttails neatly within a wearer's waistband is a pants-and-shirt shirttail retainer combination which includes a set of mating soft silicone (or other sticky or textured, friction producing material) strips of particular size, shape and location on the internal surface of the pants' waistband and on the external surface of the shirttail, respectively. Preferably, the strips lie horizontally on the waistband and vertically on the shirttail, where pressure contact of one strip on the other creates a friction force that effectively bars the shirttail from rising from the waistband. This shirttail retainer functions passively, in that no awareness or action of the user is required for it to function as intended. Thus, there is no need for a user to join or separate coupling means or to even think about them.

The second feature of this invention is a hidden cargo pocket situated on the inside surface of the pants' outseam in the area extending from the thigh to the calf, or possibly lower. In one preferred embodiment the new hidden internal cargo pocket will be located on the inside of the pants, generally opposite the location of a common external cargo pocket. Such a hidden internal cargo pocket will provide capacity generally similar to that of a conventional external cargo pocket and will be accessible from the outside, but will be essentially not visible except for the access slit at the top (upper lip). The pocket may employ gussets along the side edges for expansion purposes and may employ a zipper or other closure means at the top. If the pocket is filled, there might be a bulge but due to its internal button securing the pocket to the outseam, as the pocket is filled it expands to the inside of the wearer's leg, and not to the outside, creating minimal visible bulge. And either way, the outside seam will still be neat and uninterrupted by a conventional visible external pocket.

A third feature of this invention, in summary, is a microphone sling designed to replace conventional spring clips for attachment of a microphone to a collar or to a shirt pocket. The new microphone sling is an elongated strap having a proximal portion adapted to engage a microphone and a distal portion adapted to releasably engage a button or other coupling means situated beneath a shoulder epaulet. The coupling means could be a button sewn to the shoulder of the shirt beneath the epaulet for coupling to a button hole in the distal end of the sling, or the coupling means could be mating snap buttons or mating Velcro® elements. In all cases, the coupling means beneath the epaulet, when not in use, is either not visible or is essentially not noticeable. When the microphone sling is used, its proximal end positions the microphone to be laterally spaced from the collar and at an elevation above the breast pocket, this location being functionally and aesthetically better than attachment to the collar or to the pocket, and of course, with this sling there is no damage to the collar, to the epaulet, or to the pocket. As indicated above, when the sling is not needed, it can be easily removed, leaving an official dress uniform appearance of the shirt.

It is thus an objective of this invention to provide a Class A duty uniform that has improved functionality and performance in any or all of the above-described three features, while maintaining a neat and official dress appearance. Since a police officer, for example, may wear a bullet proof vest and wear a microphone and carry so much equipment that a cargo pocket is needed, all the novel features of this invention are included and coordinated with the shirt and pants combinations; however, these three features could be employed in different combinations or separately. In all cases, an official and neat appearance can now be better maintained. Excellent appearance of the uniform helps maintain respect from the community and self-respect and pride by the wearer.

The new hidden and secure internal cargo pocket will avoid the interruption of the smooth line along the outside seam of a pants leg that occurs with a conventional external cargo pocket, and more significantly will allow a neater, uninterrupted external stripe down the outside seam of many uniforms which until now was achievable only with pants having no cargo pockets. Securing this internal pocket with a button to a buttonhole loop inside the pant outseam not only allows for post-production customization of the external stripe, but also allows the pocket to expand to the inside of wearer's leg instead of seeing a visible bulge on the outside, and secures the pocket from flopping about when the wearer walks or runs and from sagging down when the wearer sits.

The new shirttail retainer is particularly useful to overcome the problem of shirttails pulling out due to the body armor and other equipment worn inside the shirt or on the shirt or on the pants hanging from the waist.

The new microphone sling will avoid the prior art procedure where a microphone is clipped onto a collar, or an epaulet, or a pocket which causes the look of patchwork or "jerry rigging" with unsightly pulling on one of these attachment points, as opposed to an official uniform appearance.

The new duty uniform of this invention provides the comfort and functionality of a Class B uniform with the neat and professional appearance of a traditional Class A dress uniform.

A preferred embodiment of the shirttail retainer portion of this invention includes a shirt worn with pants, a. wherein said shirt includes front and rear panels, each said panel having an upper portion, an opposite shirttail portion and a waist portion between said upper and shirttail portions, said waist portion having an outward facing surface, and b. said pants include a waistband at the top with a radially inward facing surface adapted to contact said shirt waist portion when it is worn within said pants waistband, said shirttail retainer comprising:

i. a friction strip fixed to and extending around at least part of said inward facing surface of said pants waistband, and ii. a plurality of friction elements circumferentially spaced around and fixed to said outward facing surface of said waist portion of said shirt, said friction strip and said friction elements each comprising a thin layer of silicone rubber, said friction elements, when pressed into contact with said friction strip, as a result of said pants waistband being urged radially inward against said waist portion of said shirt, establishing a frictional force that resists movement of said shirt waist portion upward relative to said pants waistband.

A preferred embodiment of the microphone sling portion of this invention is a shirt and microphone sling combination for releasably holding a microphone having an attachment clip, comprising:

a. a shirt having:

i. front and rear, right and left fabric panels, each panel having a top portion, ii. a right shoulder between said top portions of said right front and rear panels and a left shoulder between said left front and rear panels, and iii. a collar between said shoulders, b. an epaulet affixed atop each of said shoulders, c. a first coupling means affixed atop at least one of said shoulders and beneath said epaulet thereon, and d. a microphone sling formed as a strip having top and bottom parts, said top part having a second coupling means attachable to said first coupling means with said strip hanging downward therefrom to lie adjacent and against said shirt's front panel, and said bottom part adapted to be engaged by said microphone clip for releasably attaching said microphone to said sling.

A preferred embodiment of the internal cargo pocket portion of this invention which comprises a pair of pants including an internal cargo pocket comprises:

a. a pair of pants having an upper portion with a waistband, and left and right leg portions extending downward from said upper portion, each leg portion having a top part, a bottom cuff part and an intermediate part, each leg portion formed by front and rear panels which are joined along their side edges as inner and outer seams respectively, said seams extending from said cuff part upward to said upper portion of said pants, said inner seams of said two leg portions being adjacent each other, and said outer seams being remote from each other, and b. at least one internal cargo pocket formed by inner and outer panels, said panels having respective bottom and side edges joined together respectively as closed sides and a closed bottom of said cargo pocket, said panels having respectively top edges separate from each other and defining a top opening of said cargo pocket, each of said top edges extending transversely across said outer seam of said leg portion and overlying and joined to parts of said front and rear panels adjacent said outer seam.

C. BRIEF DESCRIPTION OF THE DRAWINGS

FIG. 4 is a side elevation view of the pants of FIG. 3.

FIG. 5 is a fragmentary view in section taken along line 5-5 in FIG. 4, showing the internal cargo pocket.

FIG. 6 is an elevation view of the internal cargo pocket alone.

FIG. 7 is a top front perspective view of the cargo pocket of FIG. 6.

DETAILED DESCRIPTION OF THE PREFERRED EMBODIMENTS

1. Shirttail Retainer Feature

Figure 1:
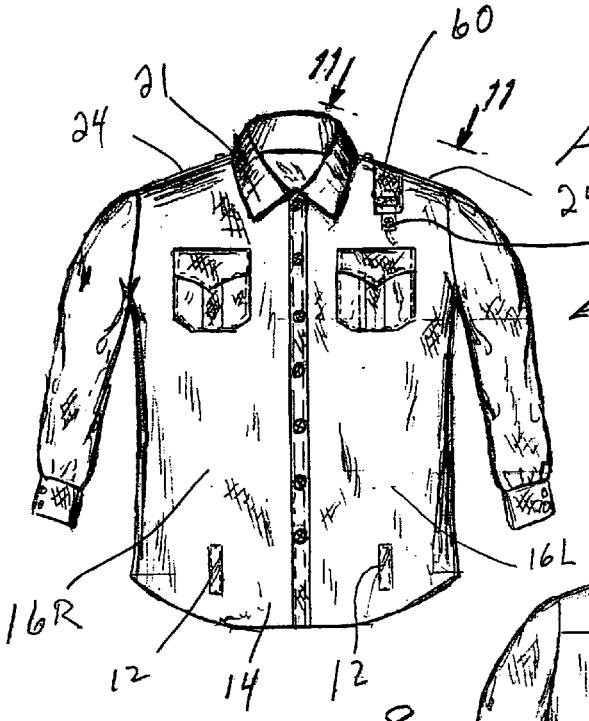
FIG. 1 is a front elevation view of a shirt of the new shirt-and-pants combination with a shirttail retainer.
Figure 2:
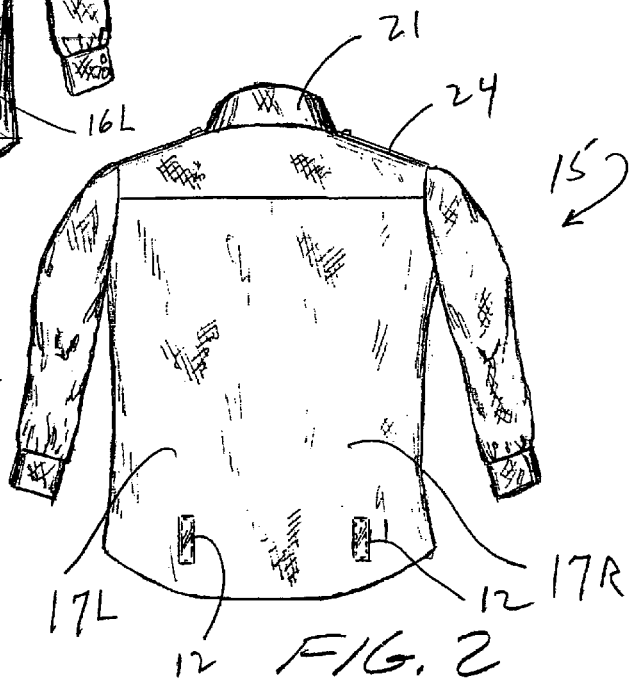
FIG. 2 is a rear elevation view of the shirt of FIG. 1.

For convenience and clarity in describing these embodiments, similar elements or components appearing in different figures will have the same reference numbers.

The shirttail retainer feature is illustrated in FIGS. 1-3 and 8-10. This feature functions by the cooperation of vertical friction strips 12 on the shirttail 14 of shirt 15 and a horizontal friction strip 18 on the inside surface of the pants waistband 19.

FIGS. 1, 2, 9 and 10 show the four vertical strips 12 on the front and rear, right and left portions of shirttail 14. Each strip 12 is about 3 inches long and ½ inch wide and is ed of soft silicone rubber about 1/32 to 1/16 inch thick, with the four edges of each strip the shirttail.

The shirt is constructed typically of right and left front panels 16R, 16L, right and left rear parts 17R, 17L formed as a single rear panel, and various other component parts for the sleeves, cuffs, collar 21, pockets, epaulets 24, buttons, stitching and optional ornamentation.

Figure 9:
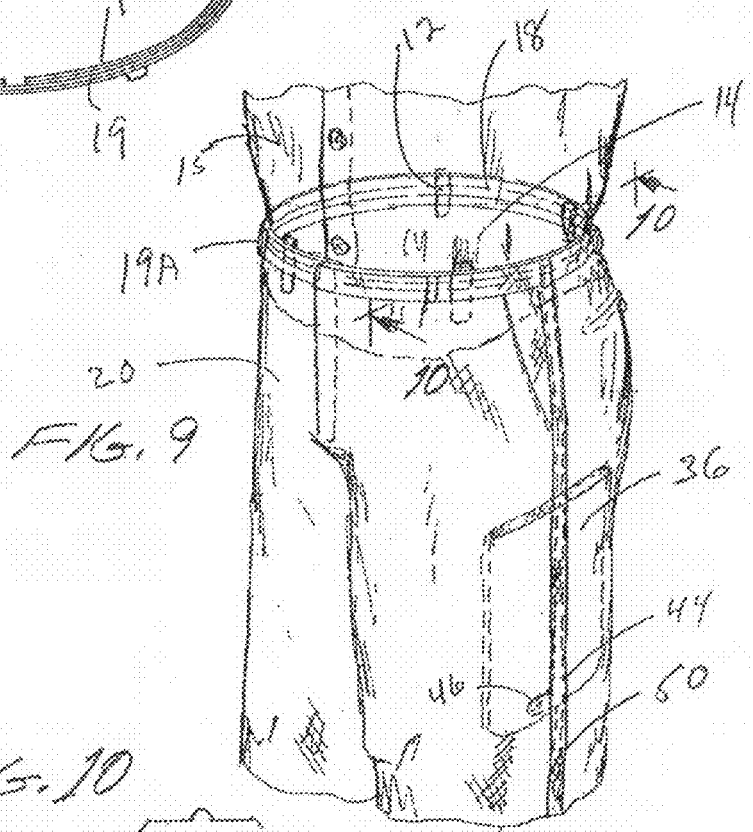
FIG. 9 is a fragmentary detail view of the shirt-and-pants combination.
Figure 10:
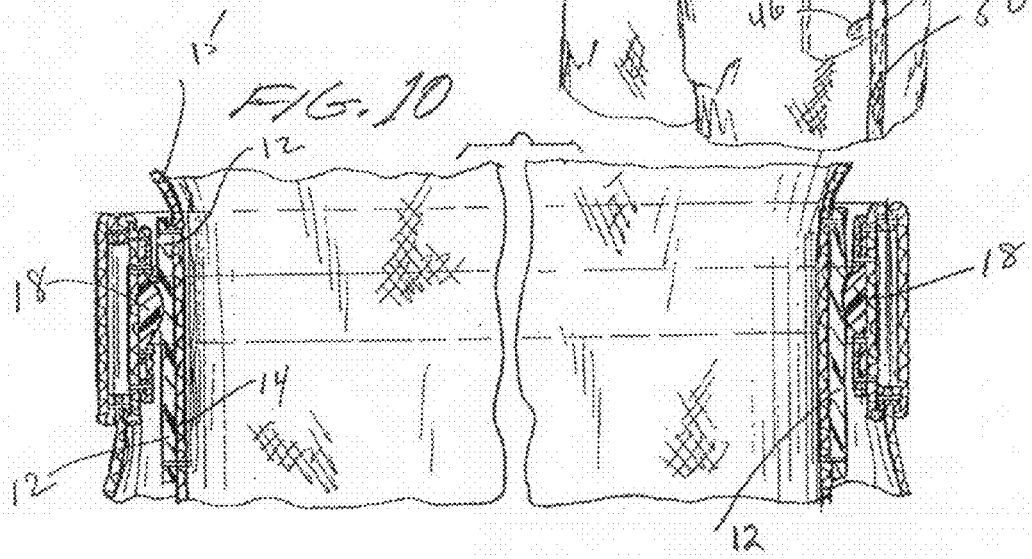
FIG. 10 is a top plan view of an epaulet and microphone sling as seen in FIG. 1.

The friction strips 12 are located generally in the middle of each front panel 16L, 16R on each of rear panel 17L,17R and at an elevation intended for them to lie generally adjacent the inside surface of waistband 19 of pants 20 waist as seen in FIGS. 9 and 10. The number and placement and sizes of these strips 12 can vary, so long as there is enough frictional surface to effectively engage the pants waistband friction strip 18 for retention of the shirttail.

Figure 3:
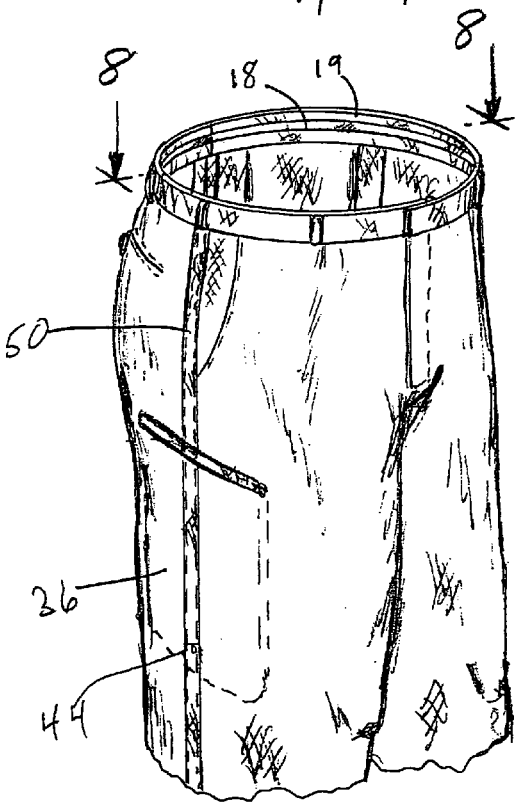
FIG. 3 is a top front perspective view of the pants of the new shirt-and-pants combination with the new internal cargo pocket.
Figure 8:
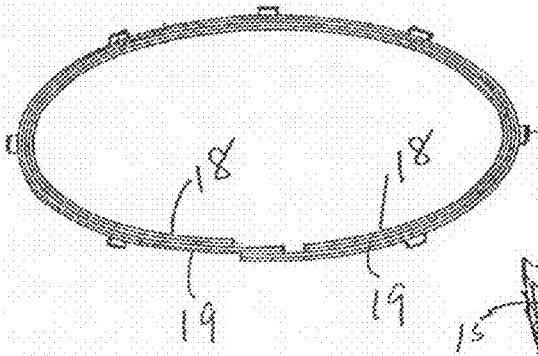
FIG. 8 is a side elevation exploded view of a shirt-and-pants combination.

As seen in FIG. 3 and FIG. 8, the pants friction strip 18 extends around substantially the entire circumference, except for the break at the fly. Thus, this pants friction strip is essentially continuous; however, a strip of spaced-apart segments could be used. FIGS. 8 and 9 show conventional external belt loops 19A.

FIGS. 9 and 10 show the juxtaposition of vertical strips 12 of the shirttail with the horizontal strip 18 of the pants waistband, when such shirt and pants are worn by a person in a conventional way. Since the length dimension shirt strips 12 is considerably greater than the height dimension of pants strip 18, the shirt-and-pants strips will become coupled even though there may be substantial variations in the dimensions of torsos, waists, chests, stomachs, etc.

The nature of these silicone rubber (or other sticky or textured substance) strips 12 and 18 is that with even mild surface-to-surface pressure contact, which will vary with the tightness or fit of the pants, frictional forces will develop, and the shirttail 14 will be retained from being pulled upward from waistband 19. Similarly, these frictional forces will help restrain the pants from slipping downward away from the shirt, even when the pants are urged downward by the weight of a gun belt, or a utility belt for other equipment, or by the weight of heavy objects in the pants pockets. They will likewise serve to keep the shirt tucked into the pants even while running or squatting or bending during work.

FIG. 10, dimensioned not necessarily to scale shows schematically, the engagement of waistband friction strip 18 with a shirttail friction strip 12. In FIG. 10 the strip 18 is shown with a slightly arcuate exposed surface pressing into a shirttail strip 12; however, strip 18 might be flat or have another contour, so long as it contacts the exposed surfaces of shirttail vertical strips 12. Additional dimensional and shape variations are possible for strips 12, which may vary from the rectangular shape illustrated herein. With a shirttail so restrained, the result will be more comfortable attire for the benefit of the wearer, and a neater and more professional appearance, likely to please both the wearer and observers. Also, with this shirttail retainer, shirts can be made with shorter shirttails, which fit better and are more comfortable in warm weather. A still further benefit is that the cooperating shirt and pants of this invention have use not limited to being used together. The shirt of this invention can be used with any pants, and the pants of this invention can be used with any shirt, obviously without the full benefit of the shirttail retaining invention.

2. Hidden Cargo Pocket Feature

The new hidden cargo pocket may be constructed in a variety of ways. FIGS. 3, 4, 5, 6, 7 and 9 show aspects of one embodiment of the new hidden cargo pocket 36 in pants formed of opposite front and rear walls whose corresponding opposite longitudinal edges are joined respectively as the inner and outer seams. As seen, pocket 36 is generally rectangular and formed of outer and inner fabric panels 37,38 joined at the sides 38S and bottom 39 and open at the top. The pocket has top and bottom lips 40,41 defining the pocket opening 42. The pocket is closable by zipper 43 which is attached to the top and bottom strips 40A,40B. Zipper is covered by pocket flap or welt 45. In the pocket shown each of the inner and outer panels has top and bottom regions and between them a main portion, with said main portion and closed sides 38S and bottom 39 being unattached to and free from said outer seam and from said front and rear walls of said pants leg. This pocket is located intermediate said top and bottom cuff parts of said leg portion. As indicated above, the pocket and its attachment to the pants may vary.

FIGS. 3, 5 and 9 show how cargo pocket 36 hangs downward. FIGS. 3, 5, 6 and 9 show a button 44 at the lower outside surface of pocket 36 for attachment into slot in tab 46 sewn to the inside surface of leg seam 48. By this feature cargo pocket 36 can be secured from flopping about when the wearer walks or runs, especially if the pocket contains one or more heavy objects, and from sagging down when the wearer sits.

Figure 4A:
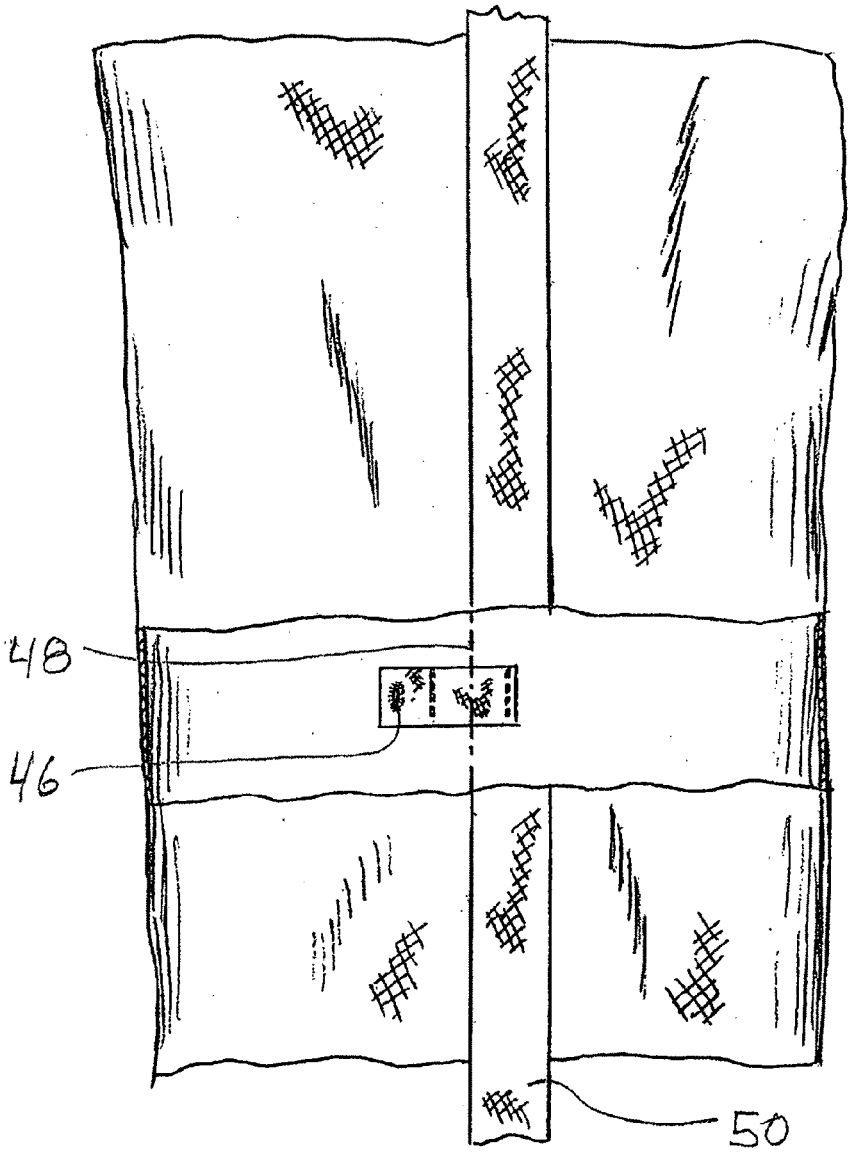
FIG. 4A is a fragmentary detail of FIG. 4 showing the outseam, stripe and buttonhole tab.

Decoupling of button 44 obviously allows the pocket to be flipped away from its normal position lying adjacent seam 48 to its customization position so that during initial manufacture or post-manufacture customization, a uniform or identifying stripe 50 can be easily sewn onto the outside surface of the seam from the cuff upward to the pocket opening 42 and a second stripe segment is sewn from the waist down to the pocket opening and onto pocket flap 45. Without the releasable button 44, conventional sewing of a uniform stripe would either: (a) cause the pocket to be captured during the sewing and sewn flat and close to the seam, or (b) cause extremely impractical manipulation of the pocket to avoid being sewn closed. Placement of the tab 46 with button slot perpendicular to the outseam with the buttonhole extending beyond the outseam toward the pant front, as seen in FIG. 4A, allows for unimpeded sewing of the stripe (traditionally placed over the outseam slightly off-center toward the pant back), while still permitting ease of buttoning to re-secure the pocket. Also seen in FIG. 4A, the stripe 50 is offset slightly to the rear from the outseam.

The practical aspect of manufacture and post-manufacture customization of these uniforms cannot be disregarded, because without highly efficient manufacture (cutting, assembling and sewing) and post-manufacture customization by dealers/distributors, these uniforms cannot be customized and sold at a reasonable cost.

It is particularly common and usually required, by tradition and/or function, that these types of uniforms for law enforcement and other activities include stripes to identify the wearers as being authentic and professional, and sometimes being to identify rank and authority.

It has been determined that cargo pockets are extremely useful, favored and/or demanded by many wearers who must carry an excessive amount of equipment. However, conventional external and externally visible cargo pockets have been objected to by many law enforcement officials, where overall good appearance, including striping along the outer leg seam is mandatory. A cargo pocket that is hidden, internally restrained and/or allows for leg striping constitutes a novel and very useful construction.

3. Microphone Sling Feature

Figure 11:
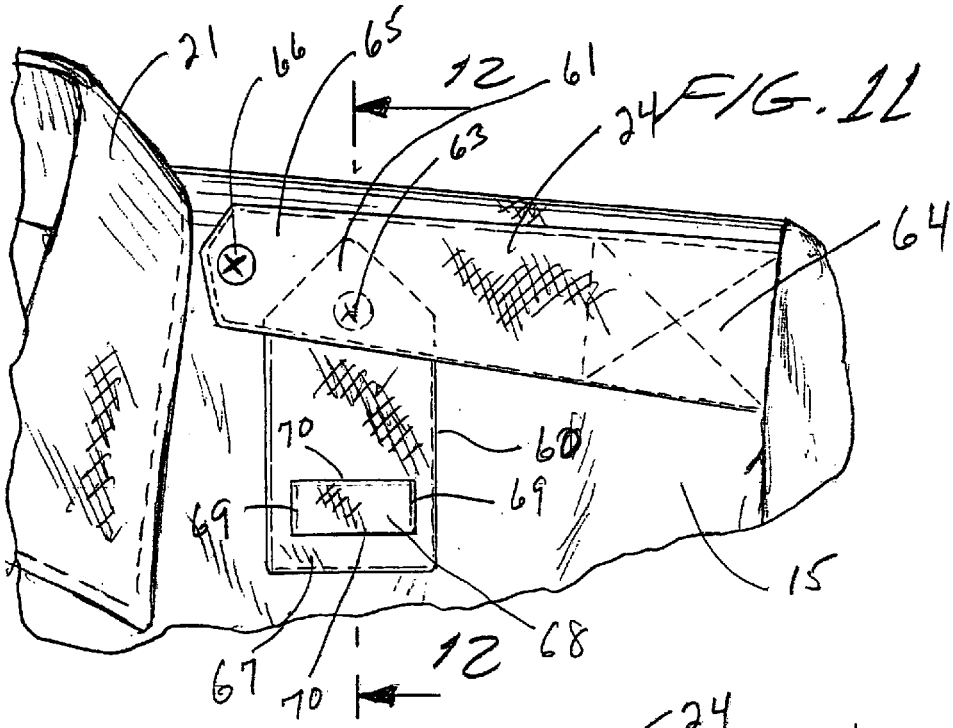
FIG. 11 is a fragmentary view in section taken along line 11-11 in FIG. 10.
Figure 12:
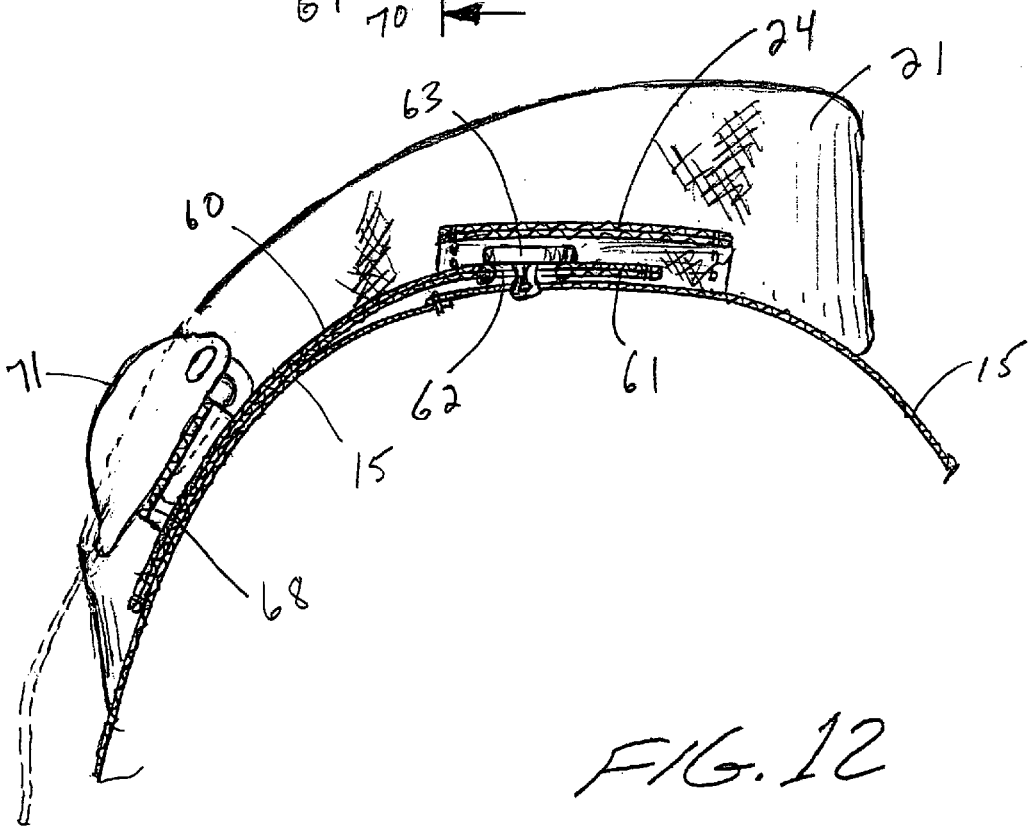
FIG. 12 is a fragmentary view in section taken along line 12-12 in FIG. 11.

As seen in FIGS. 1, 11 and 12, the new microphone sling 60 is a generally elongated fabric strip whose top end 61 is removably positioned beneath epaulet 24 by attachment of the buttonhole 62 onto button 63 which is sewn onto the shoulder of 15 beneath epaulet 24. This is a conventional epaulet that lies atop the shirt shoulder, and in this case has outer end 64 sewn to the shoulder and inner end 65 buttoned down (or secured with snap or Velcro®) to the shoulder by button 66. Thus, button 63 is essentially hidden by epaulet 24, whether this button stands alone or is coupled to the top end 61 of microphone sling 60. The bottom part 67 of microphone sling includes a short horizontal strip 68 having its ends 69 sewn to sling 60, thus leaving its top and bottom edges 70 unattached to the sling. Accordingly, a clip or other attached element can be easily connected to strip 68. In practice, a small microphone 71 (see FIG. 1) would include a clip for attachment to strip 68.

Many variations for attachment of the microphone to the sling are possible, but the objects here are:

a. to removably attach the microphone to the shirt without clipping to and damaging (or pulling for unsightly appearance) the collar, lapel, pocket or epaulet, b. to position the microphone in a functionally preferable location adjacent the collar, below the epaulet and above the pocket, c. to provide a coupling means (the sling) where the attachment means to the shirt is invisible (button hidden beneath epaulet), the sling may be totally removable when not needed with no residual evidence of its coupling, and may be replaced if and when damaged. The pants and shirt of this invention can be made of any conventional fabric, but in a preferred embodiment are made of a colorfast, breathable, comfortable, durable, wrinkle resistant fabric utilizing nano technology to provide water and stain resistance and/or moisture management. One further option with the microphone sling and with the hidden cargo pocket is to replace the button connections with Velcro® or other fastener means.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the appended claims.

The invention claimed is:

1. A shirttail retainer for a shirt worn with pants, a. wherein said shirt includes front and rear panels, each said panel having an upper portion, an opposite shirttail portion and a waist portion between said upper and shirttail portions, said waist portion having an outward facing surface, and b. said pants include a waistband at the top with a radially inward facing surface adapted to contact said shirt waist portion when it is worn within said pants waistband, said shirttail retainer comprising:

i. a friction strip having a substantially flat contact surface fixed to and extending around at least part of said inward facing surface of said pants waistband, and ii. a plurality of friction elements, each having a substantially flat contact surface circumferentially spaced around and fixed to said outward facing surface of said shirttail portion of said shirt at an elevation below the portion of the shirt that engages the waist portion of the pants, each of said friction elements comprising an elongated strip with its elongated lengthwise dimension extending in a generally top-to-bottom direction, said friction elements on said shirt, when pressed into contact with said friction strip on said pants, as a result of said pants waistband being urged radially inward against said waist portion of said shirt, establishing a frictional force that resists movement of said shirt waist portion upward relative to said pants waistband, said friction elements respectively on said shirt and on said waistband, when not in mutual pressure contact, being free of said frictional force that resists said relative movement between them when they are in pressure contact.

2. A shirttail retainer according to claim 1, wherein said friction strip on said pants waistband is a continuous strip extending around at least the majority of the circumferential length.

3. A shirttail retainer according to claim 1, wherein said friction strip and said friction elements each comprise a thin generally flat layer of silicone rubber.

4. A pair of pants formed of fabric cloth, comprising:

a. an upper portion with a waistband, b. left and right leg portions extending downward from said upper portion, each of said leg portions formed by opposite front and rear walls, each leg portion having a to art a bottom cuff art and an intermediate art each leg portion having no fabric liner inward of said front and rear walls adjacent said intermediate part, each of said front and rear walls having opposite longitudinal edges extending from said top part to said bottom cuff part, said front and rear walls of each leg portion joined by said longitudinal edges respectively in inner and outer seams, c. an internal cargo pocket formed by inner and outer panels and located intermediate said top and bottom cuff parts of said leg portion, with said outer panel of said cargo pocket adjacent said outer seam of one of said pants legs, said inner and outer panels of said cargo pocket having respective bottom and side edges joined together respectively as closed sides and a closed bottom of said cargo pocket, said cargo pocket being inside said pants leg, with said outer panel of said cargo pocket adjacent said outer seam of said pants leg, said inner and outer panels of said cargo pocket having respectively top edges separate from each other for defining a top opening of said cargo pocket, each of said top edges extending transversely across said outer seam of said leg portion and overlying and joined to said front and rear walls of said leg portion adjacent said outer seam, said outer panel of said cargo pocket adjacent said outer seam of said pants leg having top and bottom regions and a main portion between said top and bottom regions, said main portion and said closed sides of said cargo pocket being unattached to and free from said outer seam and from said front and rear walls of said pants leg, said cargo pocket's main portion and bottom region having a normal position adjacent said outer seam and being displaceable to a customization position displaced away from said outer seam.

5. A pair of pants according to claim 4, further comprising, closure means for releasably joining said top edges of said cargo pocket to each other to close and open said cargo pocket.

6. A pair of pants according to claim 5, wherein said closure means comprises a zipper having releasably connectible strips joined to said top edges respectively of said cargo pocket.

7. A pair of pants according to claim 4, further comprising coupling means for releasably attaching said bottom of said cargo pocket to said outer seam.

8. A pair of pants according to claim 4, further comprising an elongated stripe fixed to each of said leg portions, covering said outer seam and extending from said cuff bottom part upward to said top portion of said pants.

9. A pair of pants according to claim 4, having one of said internal cargo pockets attached to each of said leg portions.

10. A pair of pants according to claim 4 where said coupling means comprises a button on said bottom of said cargo pocket, and a tab with a button hole fixed to said outer wall of said pants leg.

11. A pair of pants according to claim 10 where said tab is sewn to said outer seam.

12. A pair or pants according to claim 10 where said tab has a proximal part sewn to said outer seam and a distal part extending generally perpendicularly from said proximal part with said button hole in said distal part.

13. A pair of pants according to claim 10 where said button hole is transversely offset from said outer seam.

14. A pair of pants according to claim 4 wherein said coupling means comprises a first coupling element on said bottom of said cargo pocket and a second coupling element having a proximal part fixed to said inside seam and a distal part extendable transversely therefrom and being releasably coupleable to said first coupling element.

15. A shirttail retainer combination, comprising:

a. a shirt having front and rear panels, each of said panels having an upper portion, an opposite shirttail portion and a waist portion between said upper and shirttail portions, said upper, waist and shirttail portions having an outward facing surface, b. pants including a waistband at the top with a radially inward facing surface adapted to contact said shirt when it is worn within said pants waistband, c. a friction strip having a substantially flat coupling surface fixed to and extending around at least part of said inward facing surface of said pants waistband, and d. a plurality of, friction elements, each having a substantially flat coupling surface circumferentially spaced around and fixed to said outward facing surface of said shirttail portion of said shirt, at an elevation below the portion of the shirt that engages the waist portion of the pants, e. said friction elements on said shirt, when said shirt and pants are being worn by a person and said shirt is pulled by movement of the person upward relative to said pants waistband, coming into pressure contact with said friction strip on said pants waistband, establishing a frictional force that resists further upward movement of said shirttail relative to said pants, said friction elements respectively on said shirt and on said waistband, when not in mutual pressure contact, being free of said frictional force that resists said relative movement between them when they are in pressure contact.

16. A shirttail retainer combination according to claim 15, wherein each of said friction elements fixed to said shirt comprises an elongated strip with its elongated lengthwise dimension extending in a generally top-to-bottom direction.

17. A shirttail retainer according to claim 15, wherein said friction strip on said pants waistband is a continuous strip extending around at least the majority of the circumferential length.

18. A shirttail retainer according to claim 15, wherein said friction strip and said friction elements each comprise a thin generally flat layer of silicone rubber.

19. A uniform consisting of (A) a shirt and pants combination where said shirt has shoulders between front and rear panels and an epaulet atop each shoulder and a pair of pants having an upper portion with a waistband and legs extending downward from said upper portion, each leg portion comprising outer and inner side walls with top and bottom parts of each side wall, (B) a shirttail retainer operable with said shirt and pants combination, (C) an internal cargo pocket in said pants, and (D) a microphone sling system on said shirt, where said shirt includes front and rear panels, each said panel having an upper portion, an opposite shirttail portion and a waist portion between said upper and shirttail portions, said waist portion having an outward facing surface, and said pants include a waistband at the top with a radially inward facing surface adapted to contact said shirt waist portion when it is worn within said pants waistband, wherein:

A. said shirttail retainer comprises:

(1) a friction strip having a substantially flat contact surface fixed to and extending around at least part of said inward facing surface of said pants waistband, and (2) a plurality of friction elements, each having a substantially flat contact surface circumferentially spaced around and fixed to said outward facing surface of said shirttail portion of said shirt at an elevation below the portion of the shirt that engages the waist portion of the pants, each of said friction elements comprising an elongated strip with its elongated lengthwise dimension extending in a generally top-to-bottom direction, said friction elements on said shirt, when pressed into contact with said friction strip on said pants, as a result of said pants waistband being urged radially inward against said waist portion of said shirt, establishing a frictional force that resists movement of said shirt waist portion upward relative to said pants waistband, when not in material pressure contact, being free of said frictional force that resists said relative movement between them when they are in pressure contact, B. said pants for said internal cargo pocket comprise:

(1) an upper portion with a waistband, (2) left and right leg portions extending downward from said upper portion, each of said leg portions formed by opposite front and rear walls, each leg portion having a top part, a bottom cuff part and an intermediate part, each leg portion having no fabric liner inward of said front and rear walls adjacent said intermediate part, each of said front and rear walls having opposite longitudinal edges extending from said top part to said bottom cuff part, said front and rear walls of each leg portion joined by said longitudinal edges respectively in inner and outer seams, (3) an internal cargo pocket formed by inner and outer panels and located above the knee area of the leg portion with said outer panel of said cargo pocket adjacent said outer seam of one of said pants legs, said inner and outer panels of said cargo pocket having respective bottom and side edges joined together respectively as closed sides and a closed bottom of said cargo pocket, said cargo pocket being inside said pants leg, with said outer panel of said cargo pocket adjacent said outer seam of said pants leg, said inner and outer panels of said cargo pocket having respectively top edges separate from each other and defining a top opening of said cargo pocket, each of said top edges extending transversely across said outer seam of said leg portion and overlying and joined to front and rear walls adjacent said outer seam, said outer panel of said cargo pocket adjacent said outer seam of said pants leg having top and bottom regions and a main portion between said top and bottom regions, said main portions and said closed sides of said cargo pocket being unattached to and free from said outer seam and from said front and rear walls of said pants leg, said cargo pocket's main portion and bottom region having a normal position adjacent said outer seam and being displaceable to a position displaced away from said outer seam, and C. said shirt for said microphone sling system comprises:

(1) front and rear, right and left fabric panels, each panel having a top portion, (2) a right shoulder between said top portions of said right front and rear panels and a left shoulder between said left front and rear panels, and (3) a collar between said shoulders, and (4) an epaulet affixed atop each of said shoulders, and said microphone sling system further comprises (5) first coupling means affixed to said shirt atop at least one of said shoulders and directly vertically underneath said epaulet thereon and thus not visible from directly above said shoulder, and (6) a microphone sling formed as a strip having top and bottom parts, said top part having a second coupling means releasably coupled to said first coupling means directly vertically underneath said epaulet with said strip hanging downward therefrom to lie adjacent and against said shirt's front panel, and said bottom part adapted to be engaged by said microphone clip for releasably attaching said microphone to said sling.

20. A uniform consisting of (A) a shirt and pants combination where said shirt has shoulders between front and rear panels and an epaulet atop each shoulder and a pair of pants having an upper portion with a waistband and legs extending downward from said upper portion, each leg portion comprising outer and inner side walls with top and bottom parts of each side wall, (B) a shirttail retainer operable with said shirt and pants combination, and (C) an internal cargo pocket in said pants, where (1) wherein said shirt includes front and rear panels, each said panel having an upper portion, an opposite shirttail portion and a waist portion between said upper and shirttail portions, said waist portion having an outward facing surface, and (2) said pants include a waistband at the top with a radially inward facing surface adapted to contact said shirt waist portion when it is worn within said pants waistband, said shirttail retainer comprising:

(a) a friction strip having a substantially flat contact surface fixed to and extending around at least part of said inward facing surface of said pants waistband, and (b) a plurality of friction elements, each having a substantially flat contact surface circumferentially spaced around and fixed to said outward facing surface of said shirttail portion of said shirt, each of said friction elements comprising an elongated strip with its elongated lengthwise dimension extending in a generally top-to-bottom direction, said friction elements on said shirt, when pressed into contact with said friction strip on said pants, as a result of said pants waistband being urged radially inward against said waist portion of said shirt, establishing a frictional force that resists movement of said shirt waist portion upward relative to said pants waistband, when not in mutual pressure contact, being free of said frictional force that resists relative movement between them when they are in pressure contact, and C. said pants for said internal cargo pocket comprise (1) an upper portion with a waistband, (2) left and right leg portions extending downward from said upper portion, each of said leg portions formed by opposite front and rear walls, each leg portion having a top part, a bottom cuff part and an intermediate part, each leg portion having no fabric liner inward of said front and rear walls adjacent said intermediate parts, each of said front and rear walls having opposite longitudinal edges extending from said top part to said bottom cuff part, said front and rear walls of each leg portion joined by said longitudinal edges respectively in inner and outer seams, (3) an internal cargo pocket formed by inner and outer panels and located above the knee area of the leg portion with said outer panel of said cargo pocket adjacent said outer seam of one of said pants legs, said inner and outer panels of said cargo pocket having respective bottom and side edges joined together respectively as closed sides and a closed bottom of said cargo pocket, said cargo pocket being inside said pants leg, with said outer panel of said cargo pocket adjacent said outer seam of said pants leg, said inner and outer panels of said cargo pocket having respectively top edges separate from each other and defining a top opening of said cargo pocket, each of said top edges extending transversely across said outer seam of said leg portion and overlying and joined to front and rear walls adjacent said outer seam, said outer panel of said cargo pocket adjacent said outer seam of said pants leg having top and bottom regions and a main portion between said top and bottom regions, said main portions and said closed sides of said cargo pocket being unattached to and free from said outer seam and from said front and rear walls of said pants leg, said cargo pocket's main portion and bottom region having a normal position adjacent said outer seam and being displaceable to a position displaced away from said outer seam.

21. A shirttail retainer for a shirt worn with pants, a. wherein said shirt includes front and rear panels, each said panel having an upper portion, an opposite shirttail portion and a waist portion between said upper and shirttail portions, said waist portion having an outward facing surface, and b. said pants include a waistband at the top with a radially inward facing surface adapted to contact said shirt waist portion when it is worn within said pants waistband, said shirttail retainer comprising:

i. a non "hook and loop" friction strip having a substantially flat contact surface fixed to and extending around at least part of said inward facing surface of said pants waistband, and ii. a plurality of non "hook and loop" friction elements, each having a substantially flat contact surface circumferentially spaced around and fixed to said outward facing surface of said shirttail portion of said shirt at an elevation below the portion of the shirt that engages the waist portion of the pants, each of said friction elements comprising an elongated strip with its elongated lengthwise dimension extending in a generally top-to-bottom direction, said friction elements on said shirt, when pressed into contact with said friction strip on said pants, as a result of said pants waistband being urged radially inward against said waist portion of said shirt, establishing a frictional force that resists movement of said shirt waist portion upward relative to said pants waistband, said friction elements respectively on said shirt and on said waistband, when not in mutual pressure contact, being free of said frictional force that resists said relative movement between them when they are in pressure contact.

* * * * *

UNITED STATES PATENT AND TRADEMARK OFFICE

CERTIFICATE OF CORRECTION

PATENT NO. : 7,793,359 B2
APPLICATION NO. : 11/233860
DATED : September 14, 2010
INVENTOR(S) : Roy Spiewak et al.

It is certified that error appears in the above-identified patent and that said Letters Patent is hereby corrected as shown below:

In The Claims

--10. A pair of pants according to Claim ~~4~~ 7 where said coupling means comprises a button on said bottom of said cargo pocket, and a tab with a button hole fixed to said outer wall of said pants leg.--

--14. A pair of pants according to Claim ~~4~~ 7 wherein said coupling means comprises a first coupling element on said bottom of said cargo pocket and a second coupling element having a proximal part fixed to said inside seam and a distal part extendable transversely therefrom and being releasably coupleable to said first coupling element.--

Signed and Sealed this
Twenty-eighth Day of June, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,793,359 B2
APPLICATION NO. : 11/233860
DATED : September 14, 2010
INVENTOR(S) : Roy Spiewak et al.

It is certified that error appears in the above-identified patent and that said Letters Patent is hereby corrected as shown below:

In The Claims

Column 9, lines 64-67, claim 10 should read,

--10. A pair of pants according to Claim ~~4~~ 7 where said coupling means comprises a button on said bottom of said cargo pocket, and a tab with a button hole fixed to said outer wall of said pants leg.--

Column 10, lines 9-14, claim 14 should read,

--14. A pair of pants according to Claim ~~4~~ 7 wherein said coupling means comprises a first coupling element on said bottom of said cargo pocket and a second coupling element having a proximal part fixed to said inside seam and a distal part extendable transversely therefrom and being releasably coupleable to said first coupling element.--

This certificate supersedes the Certificate of Correction issued June 28, 2011.

Signed and Sealed this
Twenty-sixth Day of July, 2011

David J. Kappos

David J. Kappos
*Director of the United States Patent and Trademark Office*